US009771845B2

(12) United States Patent
Gonze et al.

(10) Patent No.: US 9,771,845 B2
(45) Date of Patent: Sep. 26, 2017

(54) HYDROCARBON ADSORBER REGENERATION SYSTEM

(75) Inventors: Eugene V. Gonze, Pinckney, MI (US); Halim G. Santoso, Novi, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1102 days.

(21) Appl. No.: 12/828,505

(22) Filed: Jul. 1, 2010

(65) Prior Publication Data

US 2012/0000182 A1 Jan. 5, 2012

(51) Int. Cl.

| | |
|---|---|
| ***F01N 3/00*** | (2006.01) |
| ***F01N 3/08*** | (2006.01) |
| ***F01N 3/22*** | (2006.01) |
| ***F01N 3/32*** | (2006.01) |

(52) U.S. Cl.

CPC ..... *F01N 3/0814* (2013.01); *F01N 3/0878* (2013.01); *F01N 3/225* (2013.01); *F01N 3/323* (2013.01); *F01N 2590/11* (2013.01)

(58) Field of Classification Search

CPC ..... F01N 3/0814; F01N 3/0878; F01N 3/225
USPC ..... 60/272–324
See application file for complete search history.

(56) References Cited

U.S. PATENT DOCUMENTS

| | | | | |
|---|---|---|---|---|
| 5,910,293 | A * | 6/1999 | Hemingway et al. | 423/213.7 |
| 5,979,157 | A * | 11/1999 | Kinugasa et al. | 60/274 |
| 6,195,985 | B1 * | 3/2001 | del Re et al. | 60/274 |
| 6,209,518 | B1 * | 4/2001 | Machida et al. | 123/396 |
| 6,321,530 | B1 * | 11/2001 | Hoshi et al. | 60/274 |
| 6,675,574 | B2 * | 1/2004 | Nakagawa et al. | 60/284 |
| 7,080,507 | B2 * | 7/2006 | Katogi et al. | 60/289 |
| 7,444,803 | B2 * | 11/2008 | Iwamoto et al. | 60/288 |
| 2003/0056501 | A1 * | 3/2003 | Ueno et al. | 60/297 |
| 2008/0183498 | A1 * | 7/2008 | Nichols et al. | 705/2 |
| 2008/0236913 | A1 * | 10/2008 | Ichimoto | 180/65.2 |
| 2009/0025371 | A1 * | 1/2009 | Hermansson et al. | 60/286 |

FOREIGN PATENT DOCUMENTS

| | | | |
|---|---|---|---|
| DE | 69709799 | T2 | 1/2002 |
| JP | 2004169583 | A * | 6/2004 |

OTHER PUBLICATIONS

U.S. Appl. No. 12/397,798, filed Mar. 4, 2009, Brown et al.
Office Action dated Dec. 21, 2012 from the German Patent Office for German Patent Application No. 10 2011 105 625.8; 6 pages.

* cited by examiner

*Primary Examiner* — Mark Laurenzi
*Assistant Examiner* — Anthony Ayala Delgado

(57) ABSTRACT

A regeneration system includes a first module, a mode selection module and an adsorber regeneration control (ARC) module. The first module monitors at least one of (i) a temperature of a first catalyst of a catalyst assembly in an exhaust system of an engine and (ii) an active catalyst volume of the first catalyst. The mode selection module is configured to select an adsorber regeneration mode and generates a mode signal based on the at least one of the temperature and the active catalyst volume. The ARC module at least one of activates an air pump and cranks the engine to regenerate an adsorber of the catalyst assembly while the engine is deactivated based on the mode signal.

14 Claims, 7 Drawing Sheets

HYDROCARBON ADSORBER REGENERATION SYSTEM

FIELD

The present disclosure relates to hydrocarbon adsorbers of an exhaust system.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Catalytic converters are used in an exhaust system of an internal combustion engine (ICE) to reduce emissions. For example, a thee-way catalyst converter (TWC) reduces nitrogen oxide, carbon monoxide and hydrocarbons within an exhaust system. The three-way catalyst converter: converts nitrogen oxide to nitrogen and oxygen; converts carbon monoxide to carbon dioxide; and oxidizes unburnt hydrocarbons (HC) to produce carbon dioxide and water.

An average catalyst light-off temperature at which a catalytic converter typically begins to function is approximately 200-350° C. As a result, a catalytic converter does not function or provides minimal emission reduction during a warm up period that occurs upon a cold start up of an engine. Exhaust system temperatures are less than the catalyst light-off temperature during an engine cold start. During the warm up period, HC emissions may not be effectively processed by the catalytic converter.

A hydrocarbon adsorber may be used to trap HC during the warm up period. Hydrocarbon adsorbers typically trap HC when at a temperature approximately less than 200° C. and release trapped hydrocarbons at temperatures greater than or equal to approximately 200° C.

During certain driving cycles, such as start/stop applications (short engine operation periods) and short trips, hydrocarbon adsorber regeneration time may be limited. For this reason, regeneration of a hydrocarbon adsorber may not be completed, which can cause low temperature fouling of the hydrocarbon adsorber. This degrades emission performance during, for example, an engine cold start.

SUMMARY

A regeneration system is provided and includes a first module, a mode selection module and an adsorber regeneration control (ARC) module. The first module monitors at least one of (i) a temperature of a first catalyst of a catalyst assembly in an exhaust system of an engine and (ii) an active catalyst volume of the first catalyst. The mode selection module is configured to select an adsorber regeneration mode and generates a mode signal based on the at least one of the temperature and the active catalyst volume. The ARC module at least one of activates an air pump and cranks the engine to regenerate an adsorber of the catalyst assembly while the engine is deactivated based on the mode signal.

In other features, a method of operating a regeneration system includes monitoring at least one of (i) a temperature of a catalyst of a catalyst assembly in an exhaust system of an engine and (ii) an active catalyst volume of the catalyst. An adsorber regeneration mode is selected and a mode signal is generated based on the at least one of the temperature and the active catalyst volume. An air pump is activated and/or the engine is cranked to regenerate an adsorber of the catalyst assembly while the engine is deactivated based on the mode signal.

In still other features, the systems and methods described above are implemented by a computer program executed by one or more processors. The computer program can reside on a tangible computer readable medium such as but not limited to memory, nonvolatile data storage, and/or other suitable tangible storage mediums.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
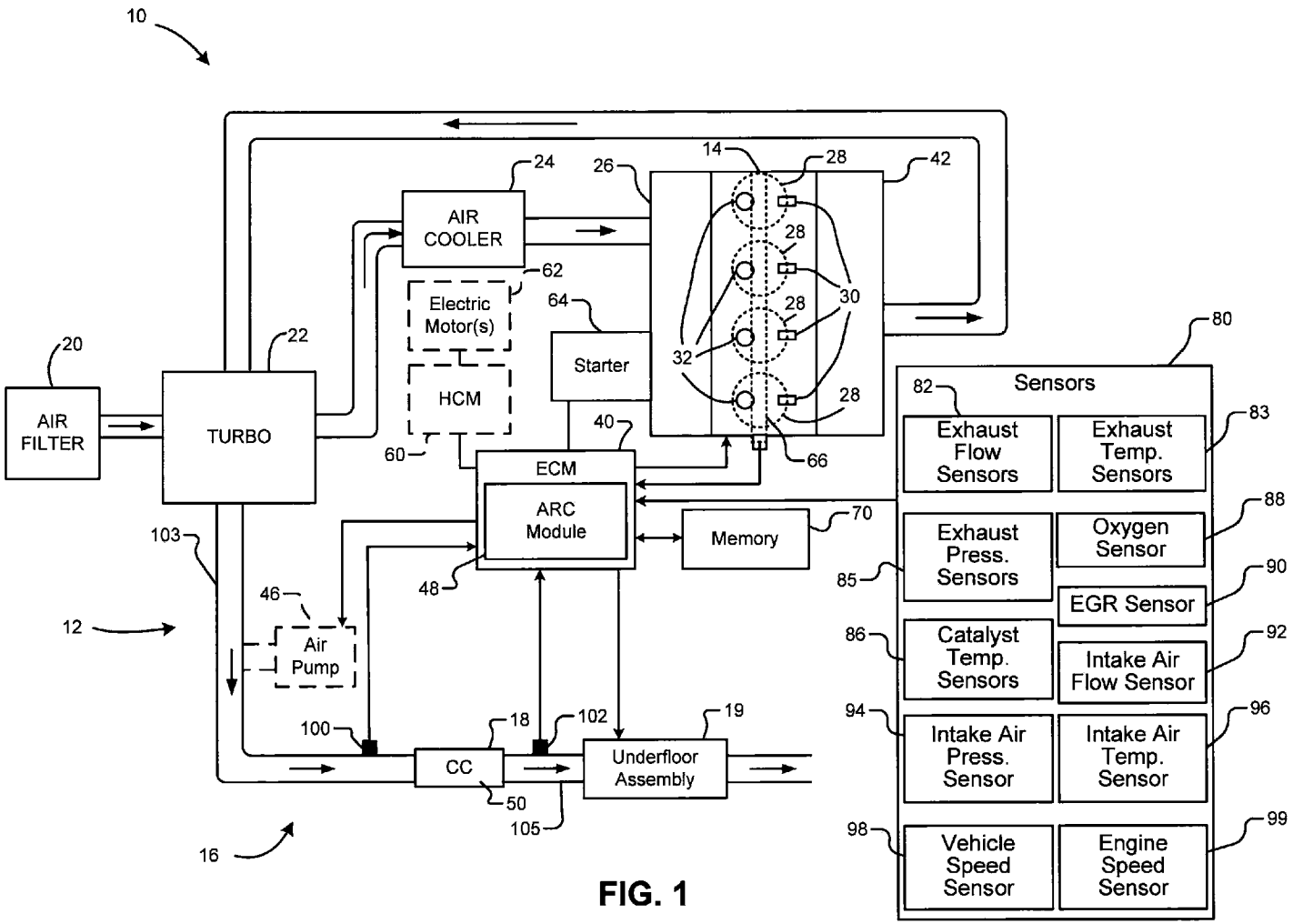
FIG. 1 is a functional block diagram of an exemplary engine system incorporating an adsorber regeneration system in accordance with the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, and/or a combinational logic circuit.

In FIG. 1, an exemplary engine system 10 that includes an adsorber regeneration system 12 is shown. The engine system 10 includes an engine 14 with an exhaust system 16. The exhaust system 16 includes a close coupled catalyst or catalytic converter (CC) 18 and an adsorber (e.g., HC adsorber) and catalyst (underfloor) assembly 19. The adsorber regeneration system 12 regenerates an adsorber of the underfloor assembly 19. Example adsorbers are shown in FIGS. 2-5. Although the engine system 10 is shown as a spark ignition engine, the engine system 10 is provided as an example. The adsorber regeneration system 12 may be implemented on various other engine systems, such as gasoline engine systems and diesel engine systems. The gasoline engine systems may be alcohol-based, such as methanol, ethanol, and E85 based engine systems.

The engine system 10 includes the engine 14 that combusts an air and fuel mixture to produce drive torque. Air enters the engine 14 by passing through an air filter 20. Air passes through the air filter 20 and may be drawn into a turbocharger 22. The turbocharger 22 when included compresses the fresh air. The greater the compression, the greater the output of the engine 14. The compressed air passes through an air cooler 24 when included before entering an intake manifold 26.

Air within the intake manifold 26 is distributed into cylinders 28. Fuel is injected into the cylinders 28 by fuel injectors 30. Spark plugs 32 ignite air/fuel mixtures in the cylinders 28. Combustion of the air/fuel mixtures creates exhaust. The exhaust exits the cylinders 28 into the exhaust system 16.

The adsorber regeneration system 12 includes the exhaust system 16 and an engine control module (ECM) 40. The exhaust system 16 includes the CC 18, the underfloor assembly 19, the ECM 40, the exhaust manifold 42, and may include an air pump 46. As an example, the CC 18 may include a three-way catalyst (TWC). The CC 18 may reduce nitrogen oxides NOx, oxidizes carbon monoxide (CO) and oxidizes unburnt hydrocarbons (HC) and volatile organic compounds. The CC 18 oxidizes the exhaust based on a post combustion air/fuel ratio. The amount of oxidation increases the temperature of the exhaust. The ECM 40 includes an adsorber regeneration control (ARC) module 48, which controls regeneration of the adsorber.

Optionally, an EGR valve (not shown) re-circulates a portion of the exhaust back into the intake manifold 26. The remainder of the exhaust is directed into the turbocharger 22 to drive a turbine. The turbine facilitates the compression of the fresh air received from the air filter 20. Exhaust flows from the turbocharger 22 to the CC 18.

The adsorber regeneration system 12 may operate in an active adsorber regeneration mode, a passive adsorber regeneration mode, or a non-adsorber regeneration mode. The active adsorber regeneration mode refers to regeneration of the adsorber when the engine 14 is deactivated or OFF. During active adsorber regeneration mode, the temperature of the adsorber is increased to be greater than or equal to a regeneration temperature (e.g., 200° C.). This allows trapped HC to be released from the adsorber. The engine may be OFF when, for example, the engine speed is equal to 0 meters per second (m/s), fuel to the engine is disabled, and/or spark is disabled. During the active adsorber regeneration mode the adsorber may be regenerated by operating in an air pumping mode. The air pumping mode may include activation of the air pump 46 and/or cranking of the engine 14. The engine 14 may be used as an air pump to inject air into the exhaust system 16 when, for example, fuel and spark of the engine 14 is disabled.

The passive adsorber regeneration mode refers to regeneration of the adsorber when the engine 14 is activated or ON. The passive adsorber regeneration mode may be performed, for example, after a cold start period. The adsorber regeneration system 12 operates in a non-adsorber regeneration mode (i.e. the adsorber is not being regenerated) during the cold start period. The cold start period refers to a period upon activation of the engine 14 when temperature of the engine 14 is less than a predetermined temperature. During the cold start period temperatures of the catalyst(s) of the exhaust system 16, such as catalysts of the CC 18 and/or the underfloor assembly 19, are increased to at least a light-off temperature. During the cold start period, the adsorber is trapping HC. During the passive adsorber regeneration mode, temperature of the adsorber is greater than or equal to the regeneration temperature.

The engine system 10 may be a hybrid electric vehicle system and include a hybrid control module (HCM) 60 and one or more electric motor(s) 62. The HCM 60 may be part of the ECM 40 or may be a stand alone control module, as shown. The HCM 60 controls operation of the electric motor(s) 62. The electric motor(s) 62 may supplement and/or replace power output of the engine 14. The electric motor(s) 62 may be used to adjust speed of the engine 14 (i.e. rotating speed of a crankshaft 66 of the engine 14).

The ECM 40 and/or HCM 60 may control operation of the electric motor(s) 62 to maintain a current engine speed during an engine speed maintaining mode or to increase speed of the engine 14 during the air pumping mode. The electric motor(s) 62 may be connected to the engine 14 via a belt/pulley system, via a transmission, one or more clutches, and/or via other mechanical connecting devices. In one embodiment, the ECM 40 and/or HCM 60 activates (powers) the electric motor(s) 62 to prevent the crankshaft 66 from rotating during the engine speed maintaining mode (engine speed maintained at 0 revolutions per minute (RPM)). This may occur when vehicle speed is greater than 0 meters (m)/second (s). The ECM 40 and/or HCM 60 may control operation of the electric motor(s) 62 and/or starter 64 to rotate the crankshaft 66 during the air pumping mode. The ECM 40 and/or HCM 60 may deactivate or adjust operation of the electric motor(s) 62 to allow the crankshaft 66 to rotate when vehicle speed is greater than 0 m/s.

During the air pumping mode, air is pumped into the exhaust system 16 to heat the adsorber. The air pump 46 and/or the engine 14 may be used to pump air into the exhaust system 16. The engine 14 is deactivated, but intake and exhaust valves of the engine 14 may be permitted to open and close. This allows air to be drawn into and pumped out of cylinders 28. The air pump 46 pumps air into the exhaust system 16 upstream from the CC 18. The air pump 46 may pump ambient air into the exhaust system 16. The ambient air may be directed to the exhaust manifold 42 and/or exhaust valves of the engine 14. Heated air that is upstream from the underfloor assembly 19 is directed through the underfloor assembly. This is performed to maintain the temperature of the absorber at a temperature greater than the regeneration temperature and/or to increase the temperature of the adsorber to be greater than or equal to the regeneration temperature.

The ECM 40 and/or HCM 60 control the engine 14, the adsorber regeneration system 12, the air pump 46, the electric motor(s) 62, and the starter 64 based on sensor information. The sensor information may be obtained directly via sensors and/or indirectly via algorithms and tables stored in memory 70. Some example sensors 80 for determining exhaust flow levels, exhaust temperature levels, exhaust pressure levels, catalyst temperatures, oxygen levels, intake air flow rates, intake air pressure, intake air temperature, vehicle speed, engine speed, EGR, etc are shown. Exhaust flow sensors 82, exhaust temperature sensors 83, exhaust pressure sensors 85, catalyst temperature sensors 86, oxygen sensors 88, an EGR sensor 90, an intake air flow sensor 92, an intake air pressure sensor 94, an intake air temperature sensor 96, vehicle speed sensor 98 and an engine speed sensor 99 are shown. The ARC module 48 may control operation of the adsorber regeneration system 12, the engine 14, the air pump 46, the electric motor(s) 62, and the starter 64 based on the information from the sensors 80.

The oxygen sensors 88 may include a pre-converter $O_2$ sensor 100 and post-converter $O_2$ sensor 102. The pre-converter $O_2$ sensor 100 may be connected to a first exhaust conduit 103 and upstream from the CC 18. The post-converter $O_2$ sensor 102 may be connected to a second exhaust conduit 105 and downstream from the CC 18. The pre-converter $O_2$ sensor 100 communicates with the ECM 40 and measures the $O_2$ content of the exhaust stream entering the CC 18. The post-converter $O_2$ sensor 102 communicates with the ECM 40 and measures the $O_2$ content of the exhaust stream exiting the CC 18. The primary and secondary $O_2$ signals are indicative of $O_2$ levels in the exhaust system 16 before and after the CC 18. The $O_2$ sensors 100, 102 generate respective primary and secondary $O_2$ signals that are feedback to the ECM 40 for closed loop control of air/fuel ratio(s).

As an example, the primary and secondary $O_2$ signals are weighted and a commanded air/fuel ratio is generated based, for example, 80% on the primary $O_2$ signal and 20% on the secondary $O_2$ signal. In another embodiment, the secondary $O_2$ signal is used to adjust a commanded air/fuel ratio that is generated based on the primary $O_2$ signal. The primary $O_2$ signal may be used for rough adjustment of an air/fuel ratio and the secondary $O_2$ signal may be used for fine adjustment of the air/fuel ratio. The ECM 40 adjusts fuel flow, throttle positioning, and spark timing based on the primary and secondary $O_2$ signals to regulate air/fuel ratio(s) in cylinders of the engine 14.

The ARC module 48 may monitor signals from the oxygen sensors 88. The ARC module 48 may, for example, adjust operation of the air pump 46, the electric motor(s) 62, and/or the starter 64 during the air pumping mode based on the signals from the oxygen sensors 88.

Figure 2:
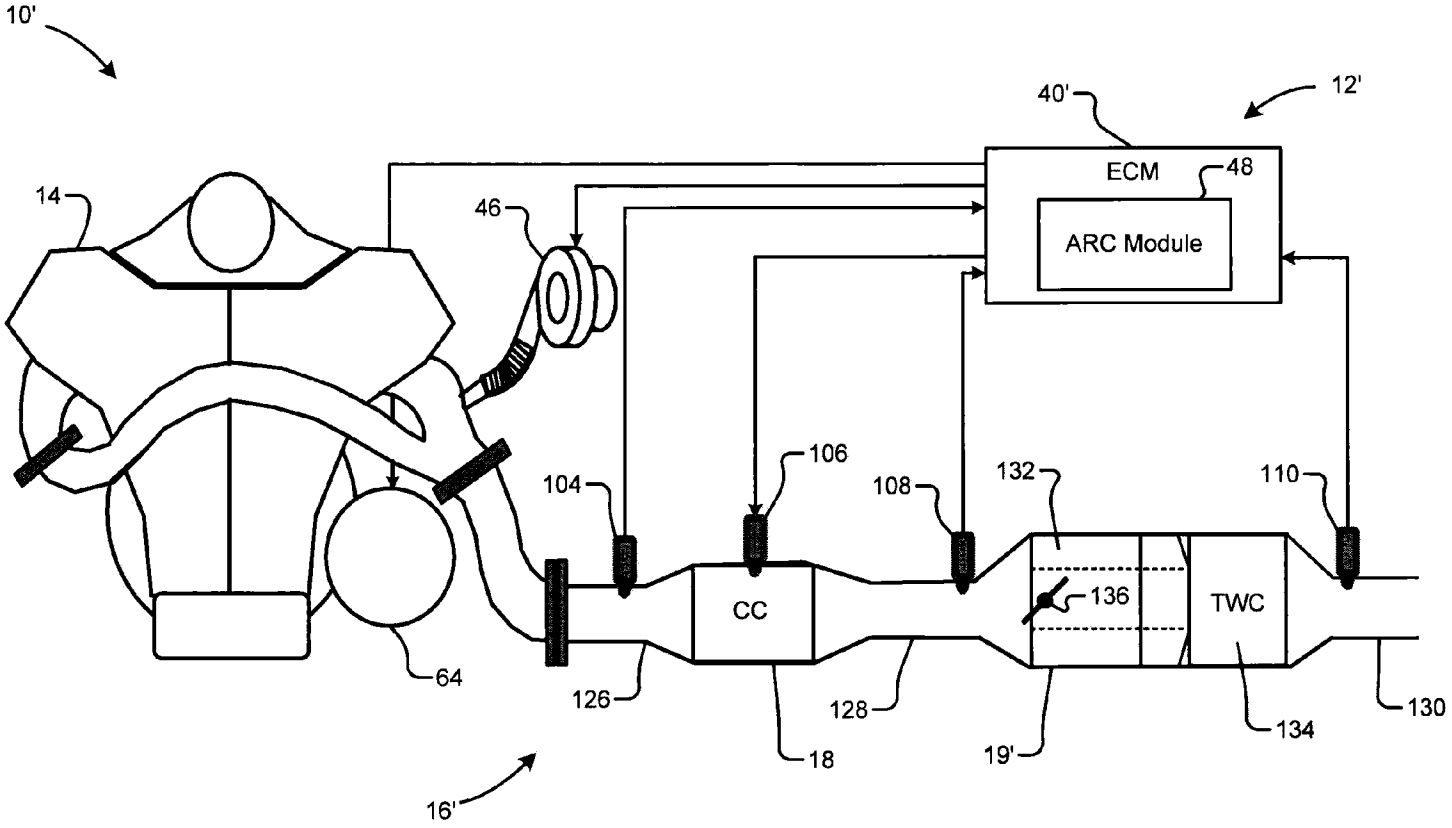
FIG. 2 is a functional block diagram of another engine system and corresponding adsorber regeneration system in accordance with the present disclosure.

Referring now also to FIG. 2, a functional block diagram of another engine system 10' is shown. The engine system 10' may be part of the engine system 10. The engine system 10' includes the engine 14, an adsorber regeneration system 12', an exhaust system 16', and an ECM 40'. In the example shown, the exhaust system 16' includes in the following order: an exhaust manifold 42', a first exhaust conduit 126, the CC 18, a second exhaust conduit 128, and an underfloor assembly 130.

The adsorber regeneration system 12' includes the engine 14, the CC 18, an underfloor assembly 19', the air pump 46, the ARC module 48, and/or the starter 64. The catalyst heating system 12' may also include exhaust flow, pressure and/or temperature sensors 104, 106, 108, 110. The first exhaust flow, pressure and/or temperature sensor 104 may be connected to a first exhaust conduit 126 and upstream from the CC 18. The second exhaust flow, pressure and/or temperature sensor 108 may be connected to the CC 18. The third exhaust flow, pressure and/or temperature sensor 106 may be connected to a second exhaust conduit 128 that is downstream from the CC 18. The fourth exhaust flow, pressure and/or temperature sensor 110 may be connected to a third exhaust conduit 130 that is downstream from the underfloor assembly 19'.

The underfloor assembly 19' may include an adsorber 132, a catalyst 134, such as a three-way catalyst, and a bypass valve 136. The adsorber 132 may be a HC adsorber and include, for example, zeolite material. The catalyst 134 oxides CO remaining in the exhaust received from the CC 18 and the adsorber 132 to generate $CO_2$. The catalyst 134 may also reduce nitrogen oxides NOx and oxidize unburnt HC and volatile organic compounds.

The ECM 40' and/or ARC module 48 controls position of the bypass valve 136 based on the mode of operation. For example, the bypass valve 136 may be in a partially or fully open position during the passive adsorber regeneration mode. As another example, the bypass valve 136 may be in a fully closed or nearly fully closed position (e.g., 95% closed) during the active adsorber regeneration mode. The bypass valve 136 may also be in the fully closed or nearly fully closed position (e.g., 95% closed) during the cold start period.

The ECM 40' may include an ARC module 48. The ARC module 48 controls operation of the adsorber regeneration system 12' based on information from the sensors 104-110 and/or sensors 80.

Figure 3:
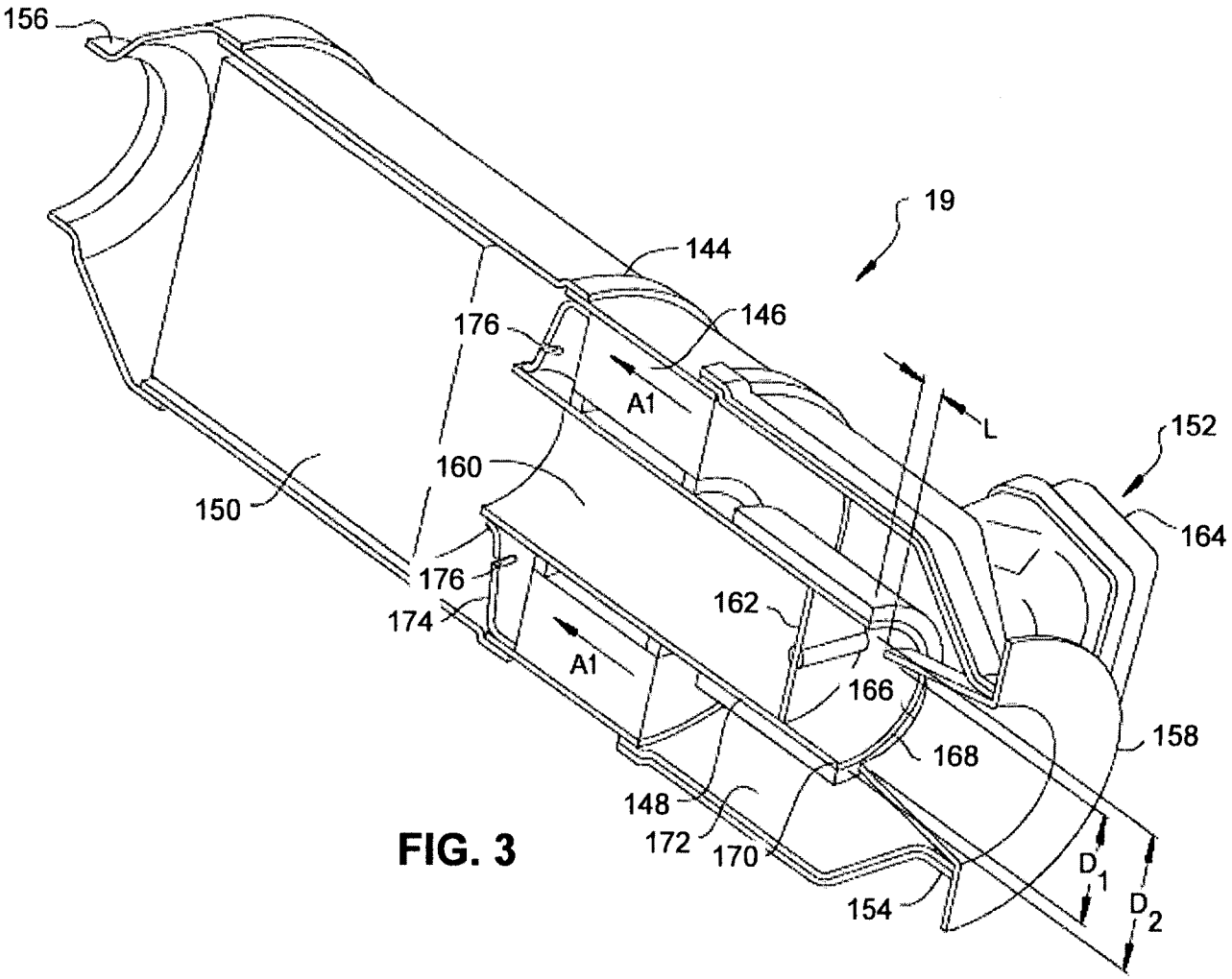
FIG. 3 is a perspective section view of a catalyst assembly in accordance with the present disclosure.
Figure 4:
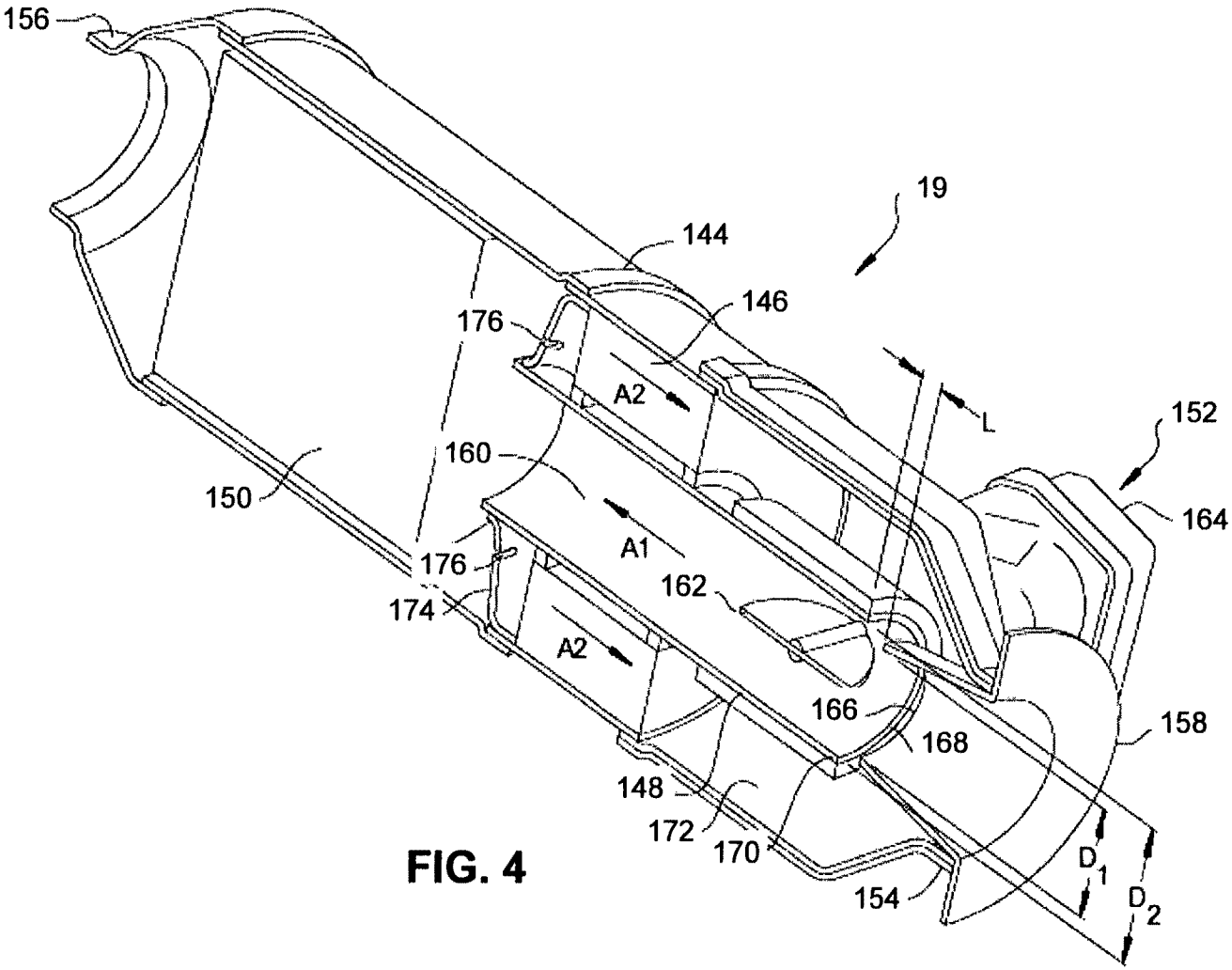
FIG. 4 is another perspective section view of the catalyst assembly in accordance with the present disclosure.
Figure 5:
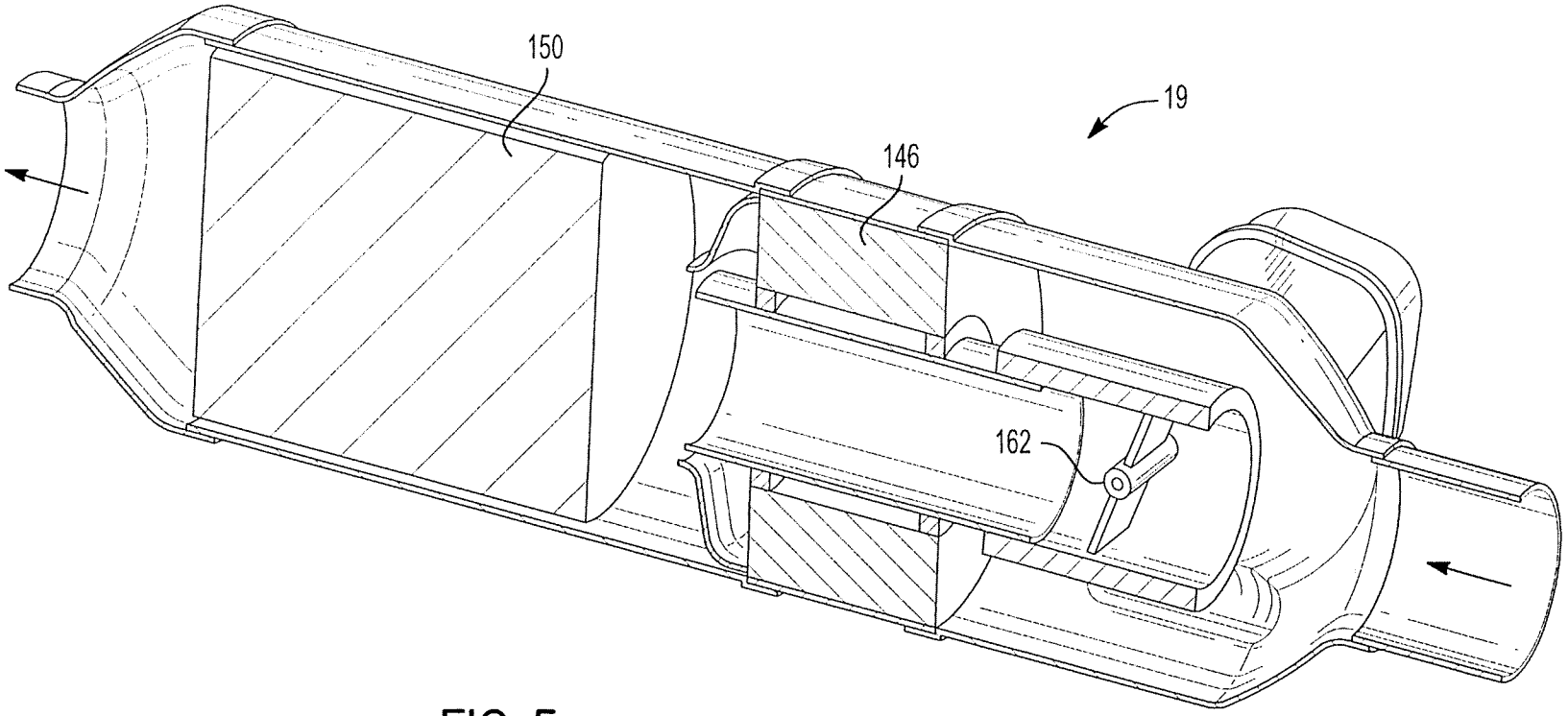
FIG. 5 is yet another perspective section view of the catalyst assembly in accordance with the present disclosure.

Referring now also to FIGS. 3-5, an example of the underfloor assembly 19 (engine exhaust gas treatment device) is shown. The underfloor assembly 19 may include a housing 144, an adsorber 146 (e.g., a HC adsorber), an adsorber bypass conduit 148, a catalyst member 150, and a bypass valve assembly 152. The housing 144 may define an exhaust gas inlet 154 and an exhaust gas outlet 156 and may include a nozzle 158 at the exhaust gas inlet 154. The adsorber 146 may be located within the housing 144 between the exhaust gas inlet 154 and an exhaust gas outlet 156 forming a first flow path between the exhaust gas inlet 154 and the exhaust gas outlet 156. As an example, the adsorber 146 may be formed from a zeolite material. The zeolite material may be used for treatment of alcohol-based fuel emissions, such as methanol emissions, ethanol emissions, E85 emissions, etc. The catalyst member 150 may include a three-way catalyst.

The adsorber bypass conduit 148 may extend through the adsorber 146 and define an adsorber bypass passage 160. The adsorber bypass passage 160 defines a second flow path between the exhaust gas inlet 154 and the exhaust gas outlet 156 parallel to the first flow path defined through the adsorber 146.

The catalyst member 150 may be located between the hydrocarbon adsorber 146 and the adsorber bypass conduit 148 and the exhaust gas outlet 156. The catalyst member 150 may receive exhaust gas exiting the adsorber 146 and/or the adsorber bypass conduit 48 depending on the position of the bypass valve assembly 152 as discussed below.

The bypass valve assembly 152 may include a bypass valve 162 located in the adsorber bypass passage 160 and an electric actuation mechanism 164 engaged with the bypass valve 162 to displace the bypass valve 162 between a closed position (shown in FIG. 3) and an open position (shown in FIG. 2). The bypass valve 162 enables passage of exhaust through the absorber bypass passage 160 between the exhaust gas inlet 154 and the exhaust gas outlet 156. The bypass valve 162 enables this passage when in the open position and inhibits (or prevents) communication between the exhaust gas inlet 154 and the exhaust gas outlet 156 when in the closed position. The bypass valve assembly 152 may also include a bypass valve sensor that detects position of the bypass valve 162. This information may be feedback to the ECM 40 and/or the ARC module 48 for position control of the bypass valve 162.

The nozzle 158 may form a converging nozzle including a nozzle outlet 166 defining a first inner diameter (D1). The nozzle outlet 166 may be located adjacent to an inlet 168 of the adsorber bypass passage 160 defined at an end 170 of the adsorber bypass conduit 148. The nozzle outlet 166 may be concentrically aligned with the inlet 68 of the adsorber bypass passage 160.

The inlet 168 of the adsorber bypass passage 160 may define a second inner diameter (D2). The first inner diameter (D1) may be less than the second inner diameter (D2). As an example, the first inner diameter (D1) may be eighty percent to ninety-nine percent of the second inner diameter (D2). The nozzle outlet 166 may also be axially spaced a distance (L) from the inlet 168 of the adsorber bypass passage 160. In the example shown, the nozzle outlet 166 is axially spaced less than 10 millimeters from the inlet 168 of the adsorber bypass passage 60. The difference between the first and second inner diameters (D1, D2) and/or distance (L) may define a spacing between the nozzle outlet 166 and the inlet 168 of the adsorber bypass passage 160.

The end 170 of the adsorber bypass conduit 148 defining the inlet 168 may extend axially outward from the adsorber 146 in a direction from the exhaust gas outlet 156 toward the exhaust gas inlet 154. The housing 144 may define an annular chamber 172 surrounding the adsorber bypass conduit 148 at a location axially between the inlet 168 of the adsorber bypass passage 160 and the hydrocarbon adsorber 146. The annular chamber 172 may be in communication with the exhaust gas inlet 154 through the spacing defined between the nozzle outlet 166 and the inlet 168 of the adsorber bypass passage 160.

The exhaust gas from the engine 14 may flow through the adsorber 146 in a first direction (A1) from the exhaust gas inlet 154 to the exhaust gas outlet 156 when the bypass valve 62 is in the closed position. The exhaust gas may flow from the exhaust gas inlet 154 through the adsorber 46 to the catalyst member 150 and out the exhaust gas outlet 156. The housing 144 may include a diffuser 174 between the hydrocarbon adsorber 146 and the catalyst member 150 and define openings 176. The openings 176 may be used to control exhaust flow rate through the adsorber 146.

The exhaust gas may bypass the adsorber 146 when the adsorber bypass passage 160 is open and proceed to the catalyst member 150. For example only, approximately 5-10% of the exhaust may flow through the adsorber when the adsorber bypass passage 160 is open (i.e. the bypass valve 162 is in the open position). A portion of the exhaust gas provided by the engine 14 may flow through the adsorber 146 in a reverse direction (discussed below) to purge HC stored within the adsorber 146 when the adsorber bypass passage 160 is open.

The exhaust gas may flow through the adsorber 146 in a second direction (A2) opposite the first direction (A1) and from the exhaust gas outlet 156 to the exhaust gas inlet 154 when the bypass valve 162 is in the open position. The exhaust gas flows through the adsorber bypass passage 160 in the first direction (A1) to the catalyst member 150 and out the exhaust gas outlet 156. The exhaust gas may flow through the adsorber 146 in the second direction (A2) may be generated by the arrangement between the nozzle outlet 166 and the inlet 168 of the adsorber bypass conduit 148. More specifically, the spacing between the nozzle outlet 166 and the inlet 168 of the adsorber bypass conduit 148 may create a localized low pressure region within the annular chamber 172.

As a result, a portion of the exhaust gas may flow from a high pressure region of the housing 144 between the adsorber 146 and the catalyst member 150 through the adsorber 146 in the second direction (A2). The exhaust gas may flow to the adsorber bypass conduit 148 through the spacing defined between the nozzle outlet 166 and the inlet 168 of the adsorber bypass conduit 148.

Figure 6:
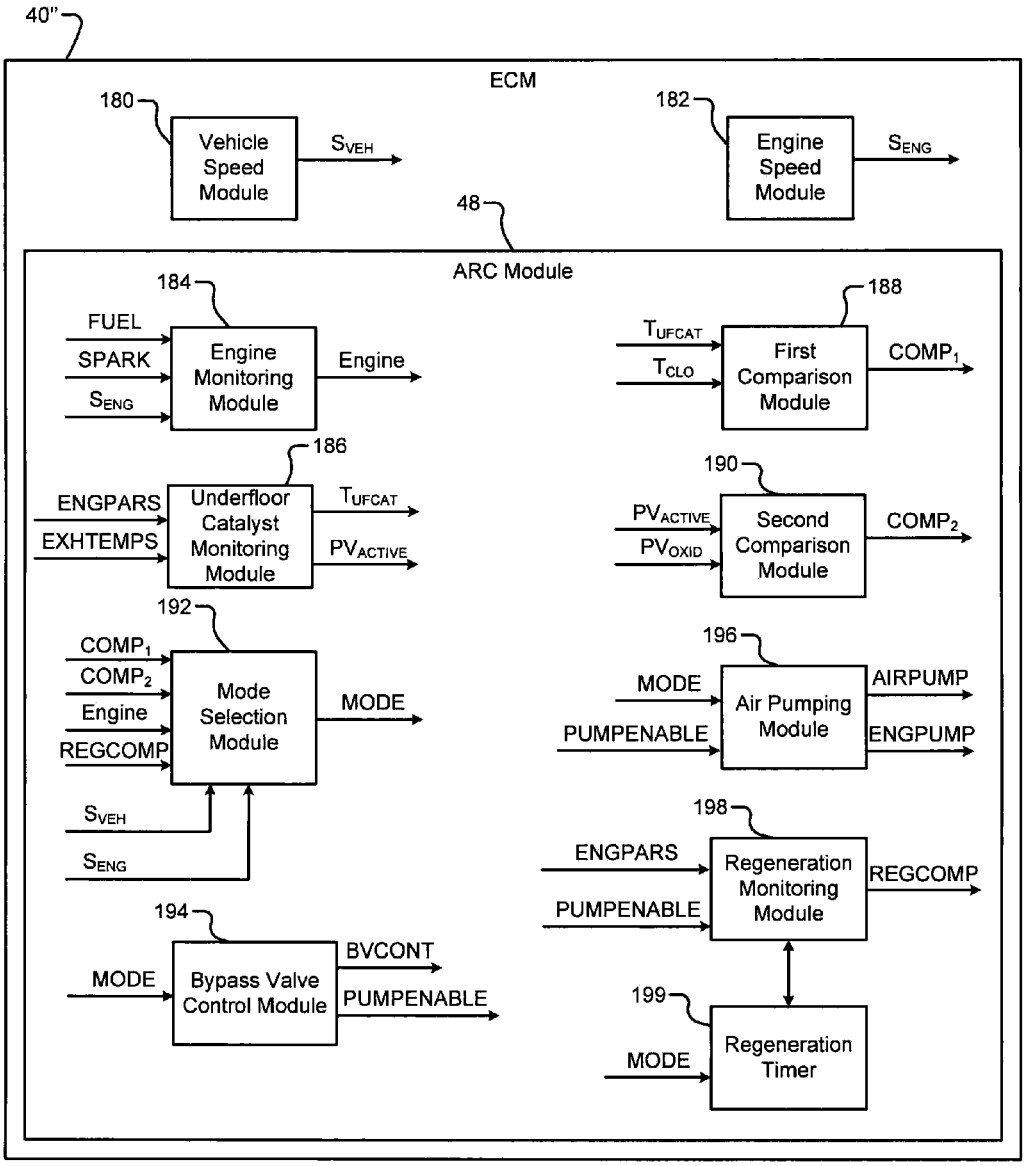
FIG. 6 is a functional block diagram of an engine control module incorporating an adsorber regeneration control module in accordance with the present disclosure.

Referring again to FIGS. 1 and 2 and to FIG. 6, where an ECM 40" is shown. The ECM 40" may be used in the absorber regeneration systems 12, 12' of FIGS. 1 and 2. The ECM 40" includes the ARC module 48 and may further include a vehicle speed module 180 and an engine speed module 182. The vehicle speed module 180 determines speed of a vehicle based on information from, for example, the vehicle speed sensor 98. The engine speed module 182 determines speed of the engine 14 based on information from, for example, the engine speed sensor 99.

The ARC module 48 includes an engine monitoring module 184, an underfloor catalyst monitoring module 186, a first comparison module 188, a second comparison module 190, a mode selection module 192, a bypass valve control module 194, an air pumping module 196 and a regeneration monitoring module 198. The ARC module 48 operates in the adsorber regeneration and non-adsorber regeneration modes. The ARC module 48 may operate in more than one of the modes during the same period.

Figure 7:
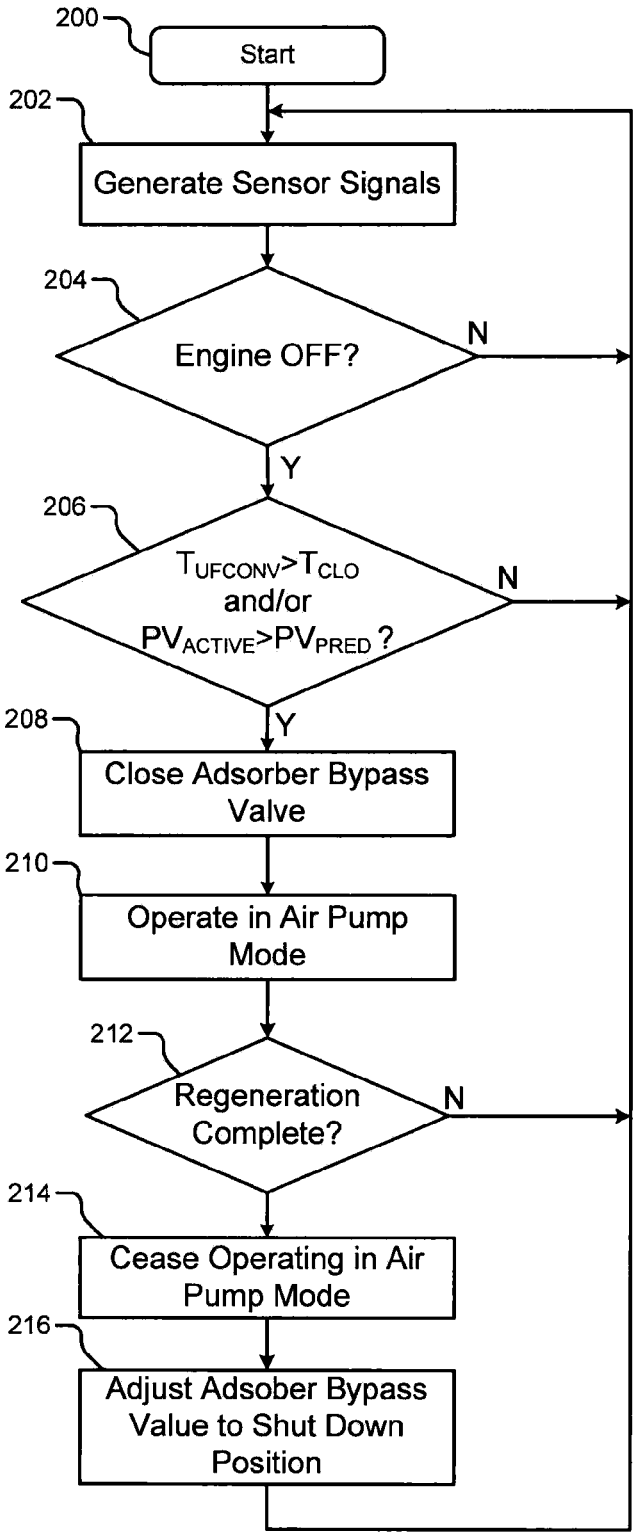
FIG. 7 illustrates a method of operating an adsorber regeneration system in accordance with the present disclosure.

Referring now also to FIG. 7, a method of operating an absorber regeneration system is shown. Although the method is described with respect to the embodiments of FIGS. 1-6, the method may be applied to other embodiments of the present disclosure. The method may begin at 200. Below-described tasks 202-216 are iteratively performed and may be performed by one of the ECMs 40, 40', 40" of FIGS. 1, 2 and 6.

At 202, sensor signals are generated. The sensor signals may include exhaust flow signals, exhaust temperature signals, exhaust pressure signals, catalyst temperature signals, an oxygen signal, an intake air flow signal, an intake air pressure signal, an intake air temperature signal, a vehicle speed signal, an engine speed signal, an EGR signal, etc., which may be generated by the above-described sensors 80 and 104-110 of FIGS. 1 and 2.

At 204, the ARC module 48 and/or the engine monitoring module 184 determines whether the engine 14 is OFF. The engine monitoring module may generate an engine monitoring signal Engine based on the engine speed signal $S_{ENG}$, a fuel supply signal FUEL and/or an ignition enable signal SPARK. The engine monitoring signal Engine indicates state of the engine. The ARC module 48 proceeds to 206 when the engine is OFF, otherwise the ARC module returns to 202.

At 206, the ARC module 48 determines whether temperature $T_{UFCAT}$ and/or active volume $PV_{ACTIVE}$ of an underfloor catalyst of an underfloor catalyst assembly, such as one of the catalyst 134, 150, is greater than a predetermined value(s). The underfloor catalyst monitoring module 186 may estimate the temperature $T_{UFCAT}$ and/or the active volume $PV_{ACTIVE}$ using a first thermal model and based on engine parameters and/or exhaust temperatures, some of which are described below with respect to equations 1 and 2. The underfloor catalyst monitoring module 186 may directly determine the temperature of the underfloor catalyst via a temperature sensor of the underfloor catalyst. The first thermal model may include equations, such as equations 1 and 2.

$$T_{UFCAT} = f\left\{\begin{matrix} F_{Rate}, S_{ENG}, C_{Mass}, C_{IMP}, T_{EXH}, DC, \\ E_{RunTime}, E_{Load}, T_{AMB}, CAM, SPK \end{matrix}\right\} \quad (1)$$

$$PV_{ACTIVE} = f\left\{\begin{matrix} T_{UFCAT}, F_{Rate}, S_{ENG}, C_{Mass}, C_{IMP}, T_{EXH}, DC, \\ E_{RunTime}, E_{Load}, T_{AMB}, CAM, SPK \end{matrix}\right\} \quad (2)$$

$F_{Rate}$ is exhaust flow rate through the CC 18, which may be a function of mass air flow and fuel quantity supplied to the cylinders 28. The mass air flow may be determined by a mass air flow sensor, such as the intake air flow sensor 92. $S_{ENG}$ is speed of the engine 14 (i.e. rotational speed of the crankshaft 66). DC is duty cycle of the engine. $C_{Mass}$ is mass of the underfloor catalyst. $C_{IMP}$ is resistance or impedance of the underfloor catalyst. $E_{RunTime}$ is time that the engine 14 is activated (ON). $E_{Load}$ is current load on the engine 14. $T_{EXH}$ may refer to a temperature of the exhaust system, and based on one or more of the temperature sensors 104-110. $T_{amb}$ is ambient temperature. CAM is cam phasing of the engine 14. SPK is spark timing. The temperature signals and the active catalyst volume signal $PV_{ACTIVE}$ may be based on one or more of the engine system parameters provided in equations 1 and 2 and/or other engine system parameters, such as mass of the underfloor catalyst $C_{Mass}$.

The first comparison module 188 may generate a first comparison signal $COMP_1$ based on the temperature $T_{UFCAT}$ and a catalyst light-off temperature $T_{CLO}$ (e.g., 250° C.). The second comparison module 190 may generate a second comparison signal $COMP_2$ based on the active catalyst volume $PV_{ACTIVE}$ and a predetermined active catalyst volume $PV_{OXID}$. The predetermined active catalyst volume $PV_{OXID}$ may be, for example, 30-40% of the volume of the underfloor catalyst. The mode selection module 192 generates a mode signal MODE based on the first and second comparison signals $COMP_1$, $COMP_2$, the engine monitoring signal Engine, the regeneration complete signal REGCOMP, the speed of the vehicle $S_{VEH}$ and/or the engine speed $S_{ENG}$.

The ARC module 48 and/or the mode selection module 192 proceeds to 208 when one or both of the comparison signals $COMP_1$, $COMP_2$ is, for example, HIGH. This indicates that temperature and/or active volume of the underfloor catalyst is at or greater than a predetermined level for oxidation of HC released from an absorber of the underfloor catalyst assembly. Otherwise, the ARC module 48 may return to 202.

At 208, the bypass valve control module 194 closes an adsorber bypass valve, such as one of the bypass valves 136, 162. This initiates the air pumping mode. The bypass valve may be fully closed. The bypass valve control module 194 generates a bypass control signal BVCONT and an air pump enable signal based on the mode signal MODE.

At 210, the air pumping module 196 generates an air pumping signal AIRPUMP and/or an engine pump signal ENGPUMP based on the mode signal MODE and the pump enable signal PUMPENABLE. The air pumping signal AIRPUMP is generated to activate an air pump, such as the air pump 46, to inject ambient air into the exhaust system. The engine pump signal ENGPUMP is generated to crank the engine to inject air from the engine into the exhaust system.

The pumping of air into the exhaust system leverages thermal energy in the engine, the close-coupled catalyst and/or other components of the exhaust system to regenerate the adsorber. The injected air is heated by the engine and exhaust system components and passed through the adsorber. This increases temperature of the adsorber to a temperature that is greater than a regeneration temperature. The adsorber than releases trapped HC, which is then oxidized by the underfloor catalyst. The temperature of the adsorber is maintained above, for example, 200° C. (regeneration temperature) during regeneration. During adsorber regeneration, temperature of the underfloor catalyst is greater than or equal to the light-off temperature due to previous engine operation. Task 208 may be performed while task 210 is performed.

At 212, the ARC module 48 determines whether regeneration of the adsorber is complete. The ARC module 48 may determine if regeneration is complete based on a thermal energy model of the adsorber and/or the underfloor catalyst using, for example, equation 3.

$$\text{Energy} = f\left\{\begin{matrix} T_{UFCAT}, F_{Rate}, S_{ENG}, A_{Mass}, C_{Mass}, A_{IMP}, C_{IMP}, T_{EXH}, DC, \\ E_{RunTime}, E_{Load}, T_{AMB}, CAM, SPK, R_{time} \end{matrix}\right\} \quad (3)$$

$A_{Mass}$ is mass of the adsorber. $A_{IMP}$ is resistance or impedance of the Adsorber. $R_{time}$ is the amount of time that the ARC module 48 is in the adsorber regeneration mode (current regeneration period). This may be measured via a regeneration timer 199. The thermal energy model refers to the thermal energy received by the adsorber and/or underfloor catalyst. The thermal energy model may include other engine characteristics, close-coupled catalyst and/or underfloor catalyst characteristics, such as sizes and volumes of the engine, the close-coupled catalyst, the adsorber, and the underfloor catalyst. Regeneration may be complete when the thermal energy Energy is greater than a predetermined thermal energy for a predetermined period and/or when the regeneration timer 199 exceeds a predetermined period.

At 214, the ARC module 48 and the air pumping module cease operating in the air pumping mode. The mode selection module 192 may generate the mode signal MODE to indicate operating in a shutdown mode. The air pump may be deactivated and the engine is no longer cranked to inject air into the exhaust system. At 216, the bypass valve control module 194 adjusts position of the adsorber bypass valve to a shut down position. The shut down position may be a partially or fully open position.

The above-described method may end during any of tasks 202-216 when, for example, when: the engine 14 is activated; the temperature of the underfloor catalyst is less than the catalyst light-off temperature $T_{CLO}$; and/or the active volume of the underfloor catalyst is less than the predetermined active volume $PV_{OXID}$. Activation of the engine 14 may include activating spark and fuel of the engine 14 and deactivating the air pump 46. The air pump 46 may be used for exothermic assistance when the engine 14 is activated to adjust temperature of a catalyst with minimal associated fuel consumption. The above-described tasks performed at 202-216 are meant to be illustrative examples; the tasks may be performed sequentially, synchronously, simultaneously, continuously, during overlapping time periods or in a different order depending upon the application.

The above-described embodiments provide HC adsorber regeneration when an engine is OFF. This prevents low temperature fouling or choking of the HC adsorber and can improve performance of an exhaust system and increase operating life of an adsorber.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A regeneration system comprising:

a first electronic circuit configured to monitor a temperature of a first catalyst of a catalyst assembly in an exhaust system of an engine;

a second electronic circuit configured to select an adsorber regeneration mode and generate a mode signal based on the temperature; and a third electronic circuit configured to determine whether the engine is deactivated based on whether fuel injection and ignition of the engine are disabled, wherein the fuel injection and the ignition of the engine are disabled when the engine is deactivated, based on the mode signal and whether the engine is deactivated, cause the engine to be cranked to pump air into an adsorber of the catalyst assembly to regenerate the adsorber while the engine is deactivated, operate the engine as an air pump by cranking the engine until a temperature of the adsorber is greater than a predetermined temperature and regeneration of the adsorber is complete, and cease from operating the engine as an air pump when the temperature of the adsorber is greater than the predetermined temperature and the regeneration of the adsorber is complete.

2. The regeneration system of claim 1, wherein the first electronic circuit is configured to estimate the temperature based on an engine speed, a flow rate, and an engine run time.

3. The regeneration system of claim 1, further comprising a fourth electronic circuit configured to initiate at least one pumping action to pump air into an inlet of the catalyst assembly during the air pumping mode, wherein:

the at least one pumping action includes (i) rotating a crankshaft of the engine when the engine is deactivated and (ii) activating an air pump, wherein the air pump is separate from the engine and is connected to the exhaust system; and the third electronic circuit is configured to control operation of an electric motor to prevent the crankshaft of the engine from rotating during an engine speed maintaining mode, and permit the crankshaft to rotate during an air pumping mode.

4. The regeneration system of claim 1, wherein the first electronic circuit is configured to compare the temperature to a catalyst light-off temperature and generates a comparison signal, wherein the second electronic circuit is configured to select an air pumping mode when the comparison signal indicates that the temperature of the first catalyst is greater than or equal to the catalyst light-off temperature.

5. The regeneration system of claim 1, a fourth electronic circuit is configured to:

control position of a bypass valve of the catalyst assembly; and close the bypass valve during regeneration of the adsorber, wherein the fourth electronic circuit is configured to maintain the bypass valve in a closed position based on the mode signal.

6. The regeneration system of claim 1, further comprising a fourth electronic circuit configured to:

determine whether regeneration of the adsorber is complete based on a thermal model of the adsorber and the first catalyst, wherein the thermal model comprises an engine speed, a flow rate, an engine run time and a regeneration period of the adsorber; and generate a regeneration complete signal based on the determination of whether the regeneration of the adsorber is complete.

7. The regeneration system of claim 6, wherein the fourth electronic circuit is configured to determine whether regeneration of the adsorber is complete based on an estimation of energy received by the adsorber and the regeneration period of the adsorber.

8. The regeneration system of claim 6, further comprising:

a fifth electronic circuit configured to cease operating in an air pumping mode based on the mode signal; and a sixth electronic circuit configured to adjust position of a bypass valve of the catalyst assembly to a shutdown position based on the mode signal, wherein the second electronic circuit is configured to generate the mode signal based on the regeneration complete signal.

9. The regeneration system of claim 1, further comprising the catalyst assembly, wherein the catalyst assembly comprises:

the first catalyst;

the adsorber upstream from the first catalyst; and a bypass valve, wherein flow of the exhaust through the adsorber is based on position of the bypass valve.

10. The regeneration system of claim 9, further comprising a second catalyst downstream from the engine and upstream from the catalyst assembly, wherein the third electronic circuit is configured to:

operate in an air pumping mode to draw thermal energy from the engine and the second catalyst to heat the adsorber to at least a regeneration temperature by operating in an air pumping mode; and activate an air pump to pump ambient air into the exhaust system upstream from the catalyst assembly during the air pumping mode.

11. The regeneration system of claim 1, wherein the first electronic circuit is a same electronic circuit as at least one of the second electronic circuit and the third electronic circuit.

12. The regeneration system of claim 1, wherein the adsorber releases hydrocarbons when the temperature of the adsorber is greater than the predetermined temperature, which regenerates the adsorber.

13. The regeneration system of claim 8, wherein each of the first electronic circuit, the second electronic circuit, the third electronic circuit, the fourth electronic circuit, the fifth electronic circuit, and the sixth electronic circuit includes at least one of an electronic circuit, an application specific integrated circuit, a processor, a memory, and a combinational logic circuit.

14. A regeneration system comprising:

an engine configured to operate in an air pumping mode while deactivated, wherein fuel injection and ignition of the engine are disabled while the engine is deactivated;

a first electronic circuit configured to monitor at least a temperature of a first catalyst of a catalyst assembly in an exhaust system of the engine;

a second electronic circuit configured to select an adsorber regeneration mode and generate a mode signal based at least on the temperature;

a third electronic circuit configured to determine whether the engine is deactivated based on whether fuel injection and ignition of the engine are disabled, wherein the fuel injection and the ignition of the engine are disabled when the engine is deactivated, and based on the mode signal and whether the engine is deactivated, cause the engine to be cranked to pump air into an adsorber of the catalyst assembly to regenerate the adsorber while the engine is deactivated; and a fourth circuit configured to determine whether regeneration of the adsorber is complete based on an engine speed, a flow rate, an engine run time and a regeneration period of the adsorber.

* * * * *